US006293716B1

(12) United States Patent
Driggers et al.

(10) Patent No.: US 6,293,716 B1
(45) Date of Patent: Sep. 25, 2001

(54) MEDIA-ACTIVATED TRANSMISSION FOR MODULAR AUTODUPLEX MECHANISM

(75) Inventors: Matt G. Driggers, Vancouver; Thomas W. Ruhe, La Center; Jeffrey R. Blackman, Vancouver, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/607,828

(22) Filed: Jun. 30, 2000

Related U.S. Application Data

(63) Continuation-in-part of application No. 09/283,107, filed on Mar. 31, 1999, now Pat. No. 6,167,231.

(51) Int. Cl.[7] ..... B41J 13/00; B41J 29/02

(52) U.S. Cl. ..... 400/578; 400/693; 347/104

(58) Field of Search ..... 399/110, 309, 399/401; 355/24; 400/578, 691, 693; 347/104

(56) References Cited

U.S. PATENT DOCUMENTS

| | | | | |
|---|---|---|---|---|
| 4,788,575 | | 11/1988 | Ito et al. | 399/13 |
| 4,974,033 | * | 11/1990 | Yamada et al. | 399/124 |
| 5,083,170 | * | 1/1992 | Sawada et al. | 399/401 |
| 5,146,087 | | 9/1992 | VanDusen | 250/271 |
| 5,384,619 | | 1/1995 | Yokomizo et al. | 399/381 |
| 5,481,354 | | 1/1996 | Nakajima | 399/371 |
| 5,600,429 | | 2/1997 | Kutsuwada | 399/17 |
| 5,638,181 | | 6/1997 | Kubo et al. | 358/296 |
| 5,772,343 | | 6/1998 | Beretta et al. | 400/624 |
| 5,790,924 | | 8/1998 | Creutzmann et al. | 399/110 |
| 5,836,706 | | 11/1998 | Ruhe | 400/636 |
| 5,839,032 | | 11/1998 | Yasui et al. | 399/124 |
| 6,167,231 | * | 12/2000 | Blackman et al. | 399/364 |
| 6,185,381 | * | 2/2001 | Nakahara et al. | 399/21 |

* cited by examiner

*Primary Examiner*—Daniel J. Colilla

(57) ABSTRACT

A modular duplex media handling system is used in conjunction with a simplex media handling print recording apparatus. The duplex media handling system is linked by a transmission to a print recording system drive motor. The drive motor drives feed rollers and metering rollers or the simplex media handling system. The transmission is media-activated to allow the duplex handling drive rollers to be disengaged, engaged for rotation in the same direction as the feed rollers, or engaged for rotation in the opposite direction as the feed rollers.

15 Claims, 8 Drawing Sheets

FIG. 11
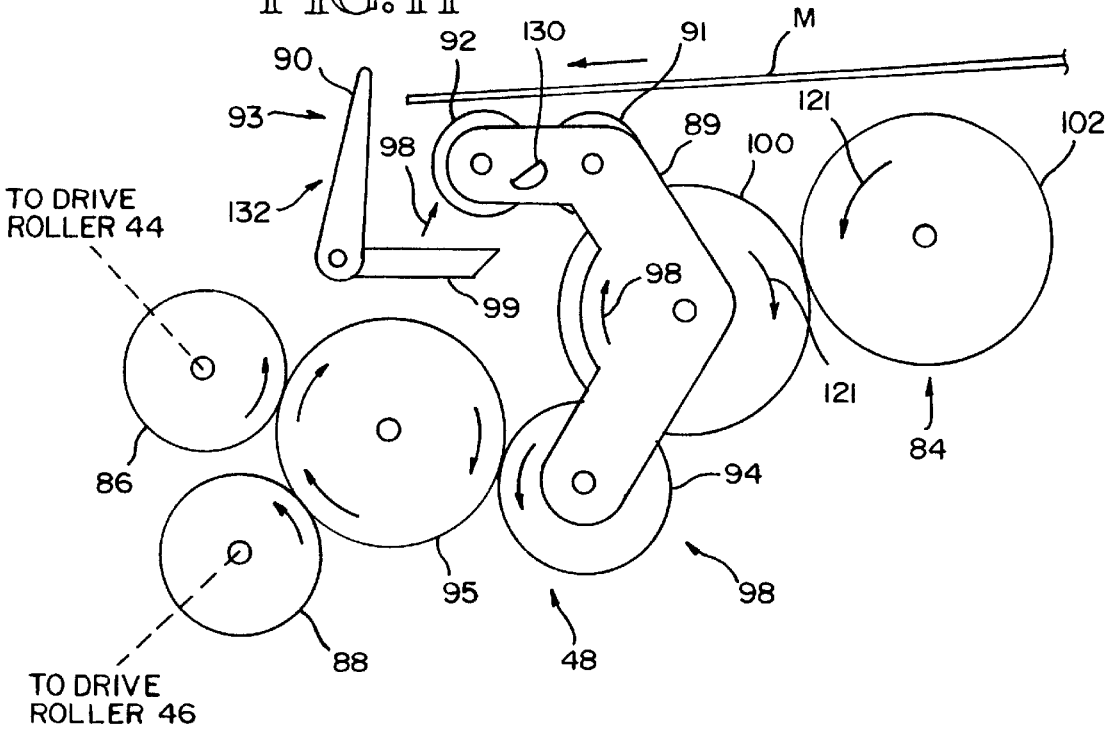
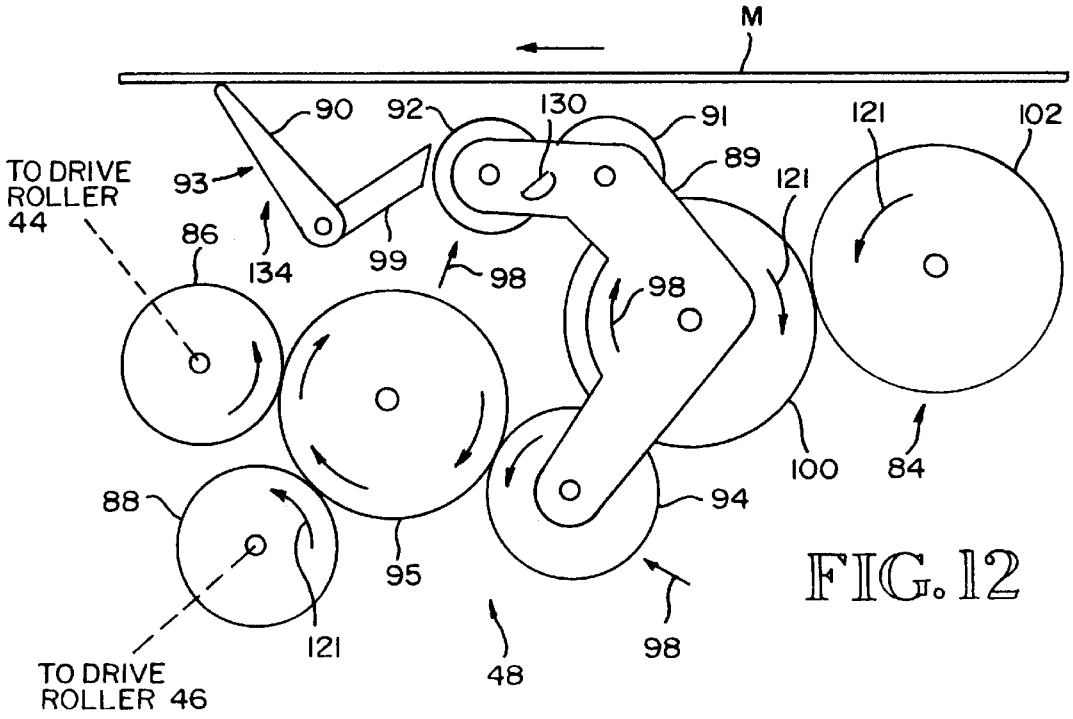
FIG. 12

FIG. 13
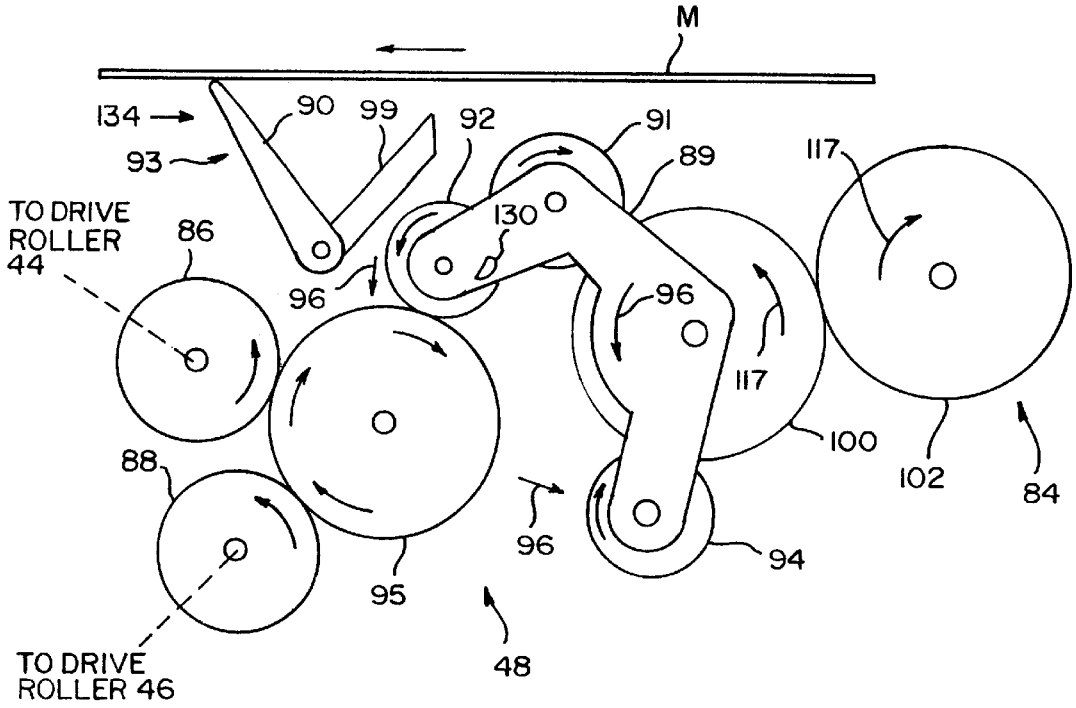
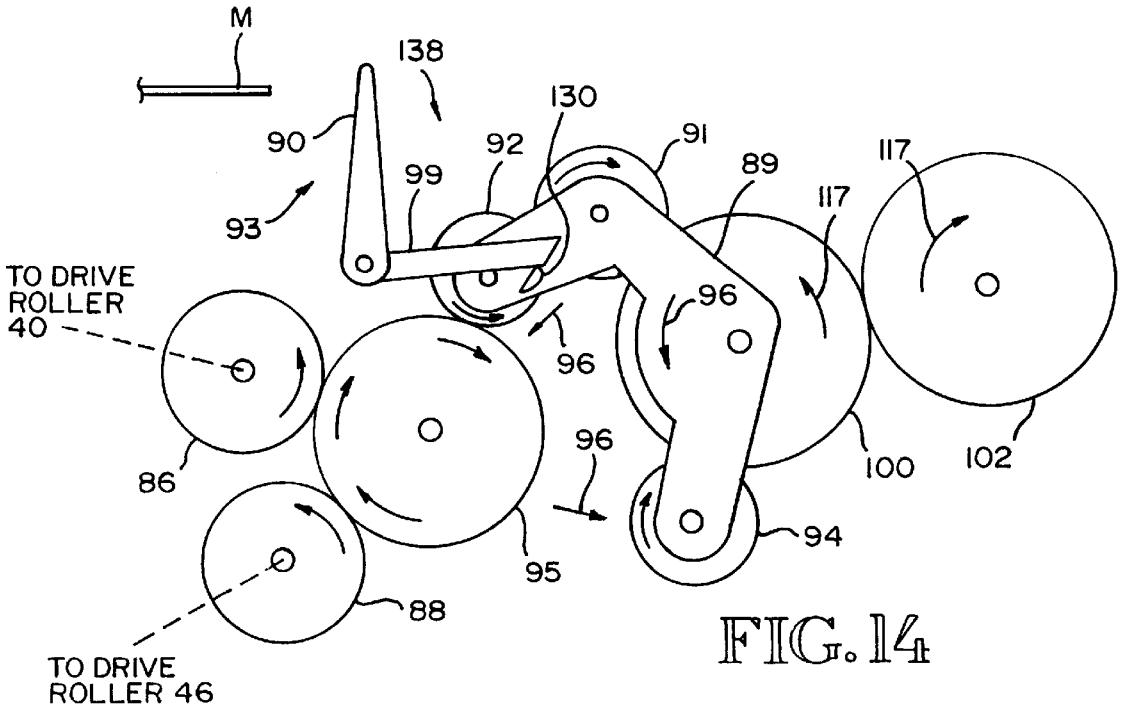
FIG. 14

MEDIA-ACTIVATED TRANSMISSION FOR MODULAR AUTODUPLEX MECHANISM

CROSS REFERENCE TO RELATED APPLICATIONS

This is a continuation-in-part of U.S. patent application Ser. No. 09/283,107 filed Mar. 31, 1999 now U.S. Pat. No. 6,167,231, of Jeffrey Blackman et al. for "Print Recording Apparatus Having Modular Autoduplex Mechanism". The content of such application is incorporated herein by reference and made a part hereof.

BACKGROUND OF THE INVENTION

This invention relates generally to methods and apparatus for printing on two sides of a media sheet, and more particularly, to a media handling system which first feeds a media sheet with a first side exposed to a print source, then feeds the media sheet with a second side exposed to the print source.

Printing to two sides of a media sheet, referred to as duplex printing, is a desirable feature in printing systems. The advantages of duplex printing include reducing the amount of paper required compared to one-sided (simplex) printing, and generating print sets with layouts resembling that of professionally printed books. Conventional duplex printing devices employ complex paper handling mechanisms. Typically, an extra tray is used for temporary storage of pages having printing on a first side. In an alternative approach a second paper path is provided to route a first printed page around the existing paper supply.

Similarly, duplex copying typically is accomplished by either one of two methods. In one method, first side copies are stacked in a duplex tray. When a set of first side copies is complete, the copies are fed out of the duplex tray and returned with an odd number of inversions along, a duplex path to receive second side imaging. In an alternative method first side copies are returned directly to receive second side imaging without stacking.

Conventional devices tend to have long paper paths and many parts. A substantial challenge with systems having these complex duplex printing paper paths is handling paper jams. Accordingly, there is a need for a simplified method and apparatus for duplex media handling at a desktop print recording device.

SUMMARY OF THE INVENTION

According to the invention, a modular duplex media handling system is used in conjunction with a simplex media handling, print recording apparatus. The simplex media handling system includes firmware for operating either in a simplex mode or in a duplex mode, (where the modular duplex media handling system is installed to operate in duplex mode).

According to one aspect of the invention, the modular duplex media handling system includes linkage to the print recording system drive motor. The drive motor drives the feed rollers and the metering rollers of the simplex media handling system and the duplex handling drive rollers of the duplex media handling system. A transmission apparatus allows the duplex handling drive rollers to be disengaged, engaged for rotation in the same direction as the feed rollers, or engaged for rotation in the opposite direction as the feed rollers.

One advantage of the invention is that the transmission switches gears in response to a lever activated by the media sheet motion, rather than in response to a drive motor jogging, action. As a result, the time to shift gears is reduced. Correspondingly, the time to perform a duplex handling print cycle is reduced, and the printer throughput is increased. Another advantage is that by avoiding activation by the drive motor, a larger design margin is tolerated by the gear trains ill the transmission. Another advantage is that a lighter friction load is placed on the drive motor by the interference member. In the embodiment where the clutch is activated by the drive motor a higher, undesirable friction load is placed on the drive motor. Such load is not constant over the life of the printer. Also, placing a higher friction load on the drive motor reduces accuracy in controlling print media stopping, thereby compromising printed image quality. The interference member places a much lower, less critical friction load on the drive motor. According to another advantage of the invention, by activating the transmission drive modes directly in response to the media sheet position, precise drive motor position control is not needed (as it would in embodiments where the clutch is driven by the drive motor). The direct actuation of the transmission drive mode frees up bandwidth for the print controller. These and other aspects and advantages of the invention will be better understood by reference to the following detailed description taken in conjunction with the accompanying drawings.

BRIEF DESCRIPTION OF THE DRAWINGS

FIG. 11 is a diagram of the transmission and a portion of the gear linkage of FIG. 4 with the transmission in second gear before the lever mechanism is tripped by a media sheet;

FIG. 12 is a diagram of the transmission and a portion of the ear linkage of FIG. 4 with the transmission in second gear in which the lever mechanism is tripped by a media sheet;

FIG. 13 is a diagram of the transmission and a portion of the gear linkage of FIG. 4 with the transmission in first gear while the lever mechanism is still tripped by a media sheet; and FIG. 14 is a diagram of the transmission and a portion of the gear linkage of FIG. 4 with the transmission in first gear after the media sheet has cleared the lever mechanism.

DESCRIPTION OF SPECIFIC EMBODIMENTS

Overview

Figure 1:
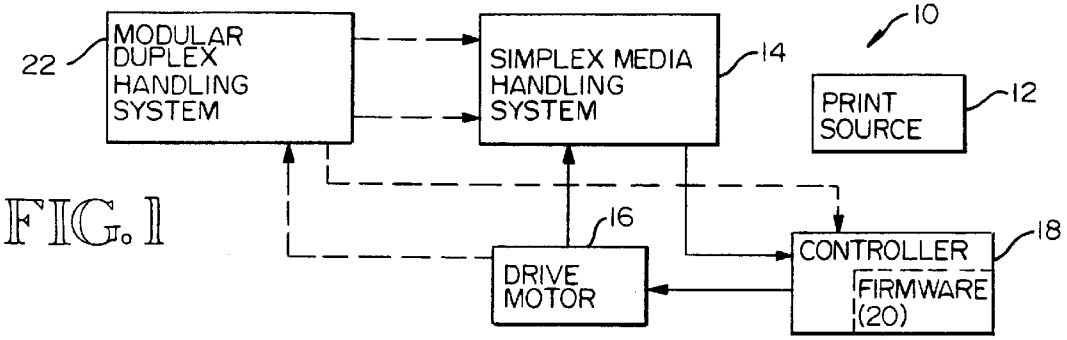
FIG. 1 is a block diagram of a print recording system according to an embodiment of this invention.

Referring to FIG. 1, a print recording system 10 includes a print source 12, a simplex media handling system 14, a drive motor 16 and a controller 18 with firmware 20. Also included in the system 10 is a modular duplex media handling system 22. The duplex media handling system 22 is removable, allowing the system 10 to be customized for simplex printing, models and duplex printing models.

Figure 2:
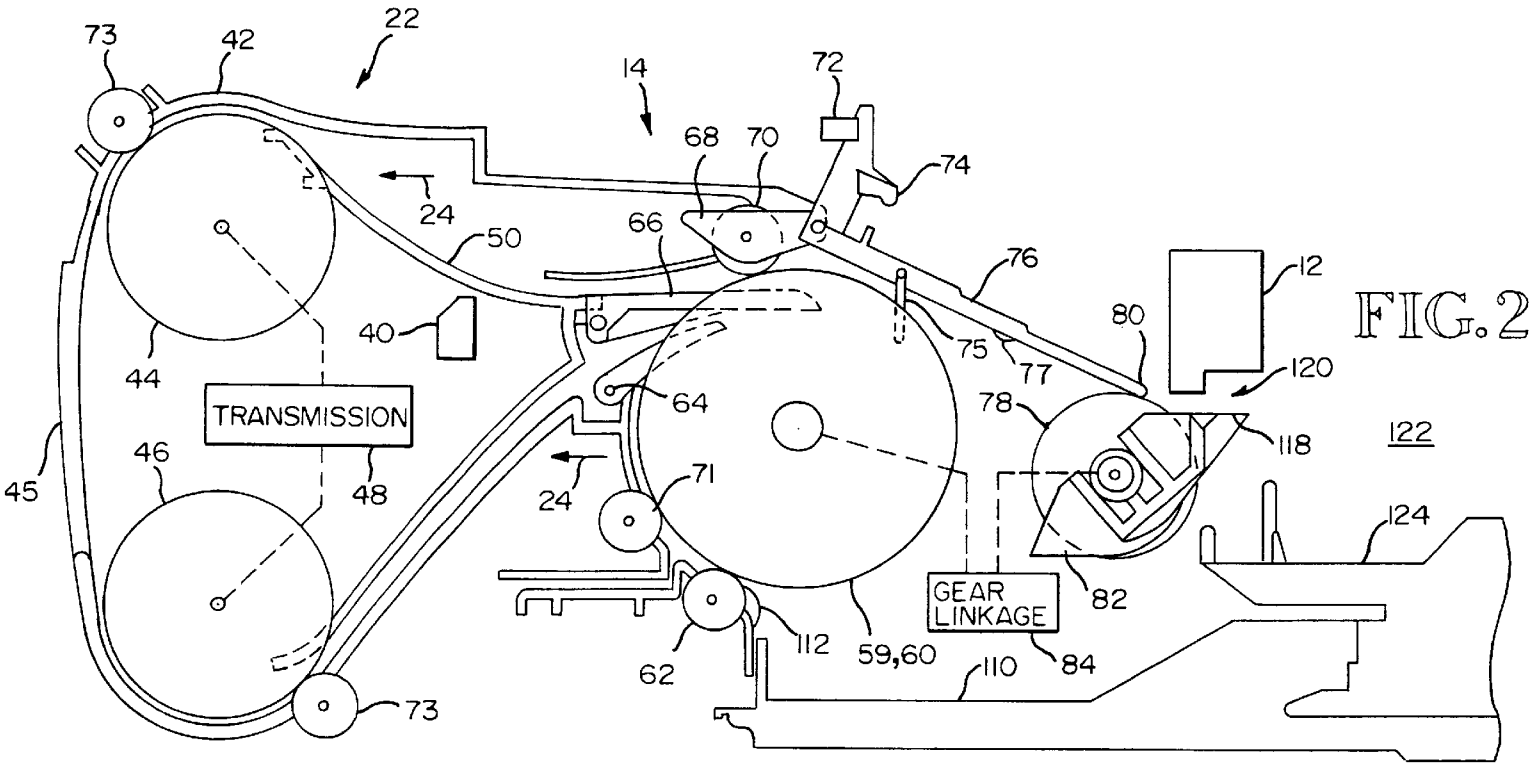
FIG. 2 is a planar view of a portion of the simplex media handling system and modular duplex handling system of FIG. 1 according to an embodiment of this invention.
Figure 3:
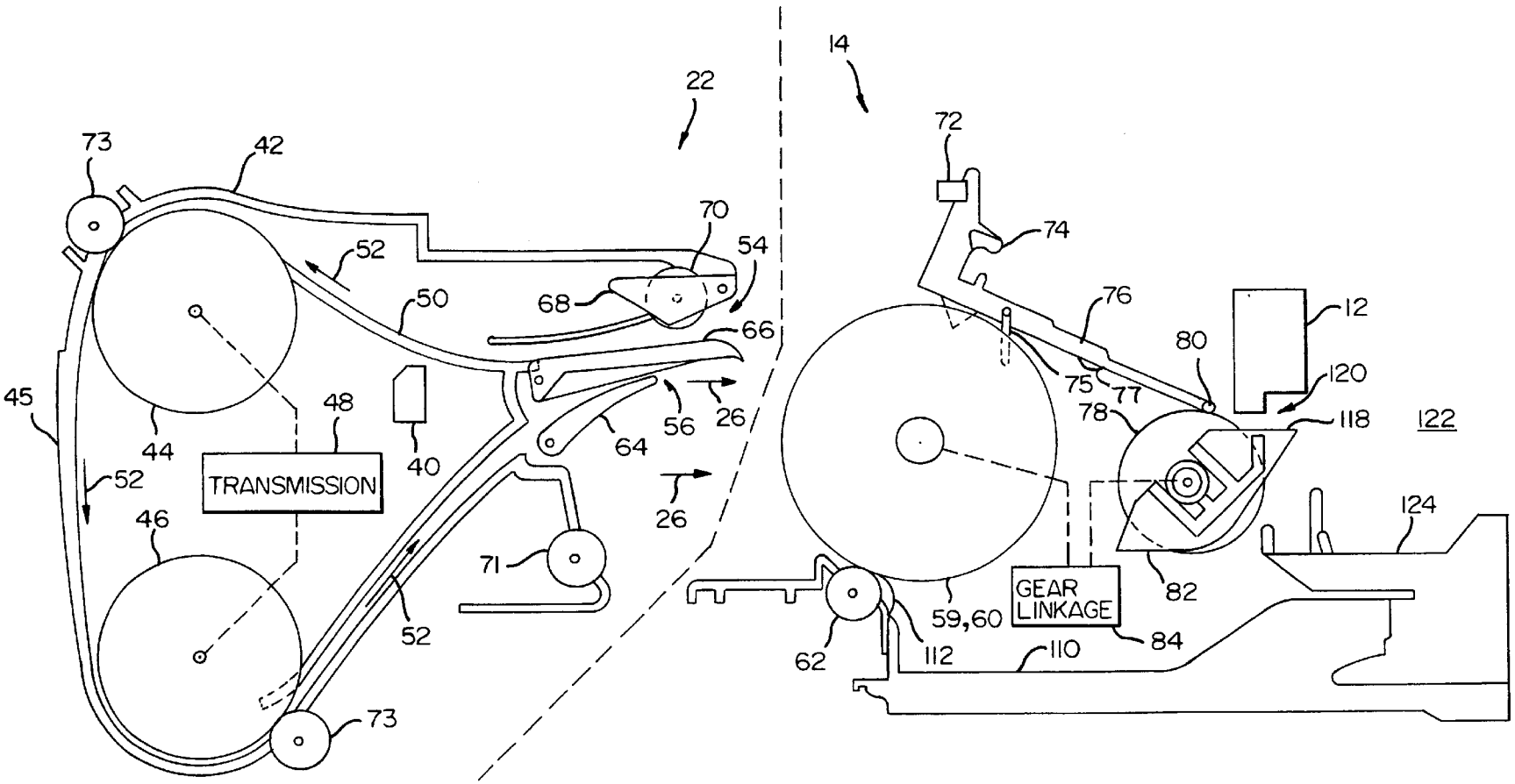
FIG. 3 is an exploded planar view of the duplex handling system separated from the simplex handling system of FIG. 2 according to an embodiment of this invention.

Referring to FIG. 2, the print source 12, simplex media handling system 14 and duplex media handling system 22 are shown for an inkjet printer embodiment. FIG. 3 shows the same structure with the duplex handling system 22 detached. The duplex media handling system 22 is easily removed by sliding the module 22 in direction 24 (see FIG. 2), then lifting the module away from the simplex media handling system 14. The duplex media handling system 22 is installed by removing a rear access door, then lowering the system 22 into a housing for the print recording system 10. The duplex media handling system 22 then is slid in direction 26 (see FIG. 3) toward the simplex media handling system 14. The duplex media handling, system 22 engages to the simplex media handling system 14 using the same mechanical interface as was used for the removed rear access door.

The duplex media handling system 22 includes a sensor 40 which interfaces with the controller 18, allowing the controller 18 to detect whether the duplex media handling system 22 is present in the print recording system 10. An electrical, electro-mechanical and/or electro-optical connection is included to interface the sensor 40 output with the controller 18. The controller 18 tests to determine whether the duplex media handling system 22 is installed. Specifically, if a sensor 40 signal is present, then the system 22 is installed (since the sensor is part of the system 22). In response, the controller 18 firmware 20 enables both simplex printing and duplex printing operations. If a sensor 40 signal is not present, then the controller 18 firmware 20 disables duplex printing operations and allows simplex printing operations.

In operation the print recording system 10 receives a media sheet upon which text, graphics or other symbols are to be recorded. For example, in an inkjet printer embodiment the printer receives a print job from a host computer (not shown). The controller 18 controls the drive motor 16 and print source 12 coordinating, the movement of the media sheet relative to the print source 12. For single-sided (i.e., simplex) printing, the media sheet is fed through the simplex media handling system 14 adjacent to the print source 12 where the text, graphics or other symbols are recorded on the media sheet. For duplex printing, the media sheet is fed through the simplex media handling, system 14 along a media path to perform first-side printing. The media sheet then is fed back along a portion of the media path into the duplex handling system 22 which flips the media sheet, then returns the media sheet to the simplex media handling system 14 for second side printing.

Referring to FIG. 3, the duplex media handling system 22 includes the sensor 40, a frame 42, panel 45, a pair of drive rollers 44, 46, a transmission 48, flip guides 64, 66, pinch rollers 70, 71, 73, and roller sleds 68. The transmission 48 is coupled to the print recording system's drive motor 16. During duplex printing, a media sheet is fed within the duplex media handling system 22 along a loop media path 52. The media sheet is received at flip guide 66 and fed by the simplex media handling system 14 along a paper guide 50 of the frame 42 toward the first drive roller 44. The drive roller 44 moves the media sheet along the path 52 to the second drive roller 46, which in turn, moves the media sheet out of the modular duplex handling system 22 back to the simplex media handling, system 14. The duplex module media path 52 is a loop having an entry point 54 in the vicinity of the exit point 56. Both the entry point 54 and the exit point 56 are adjacent to a common area of the simplex media handling system 14.

Referring to FIGS. 2 and 3, the simplex media handling system 14 includes pick roller 59, feed rollers 60, feed idlers 62, a media sensor 72, flag 74, secondary flag 75, an upper guide 76, and metering rollers 78 with another set of pinch rollers 80, a pivot mechanism 82 and gear linkage 84. The drive motor 16 (see FIG. 1) is coupled to the feed rollers 60 and metering rollers 78 through the gear linkage 84. An opening is included for receiving the duplex media handling system 22.

Figure 4:
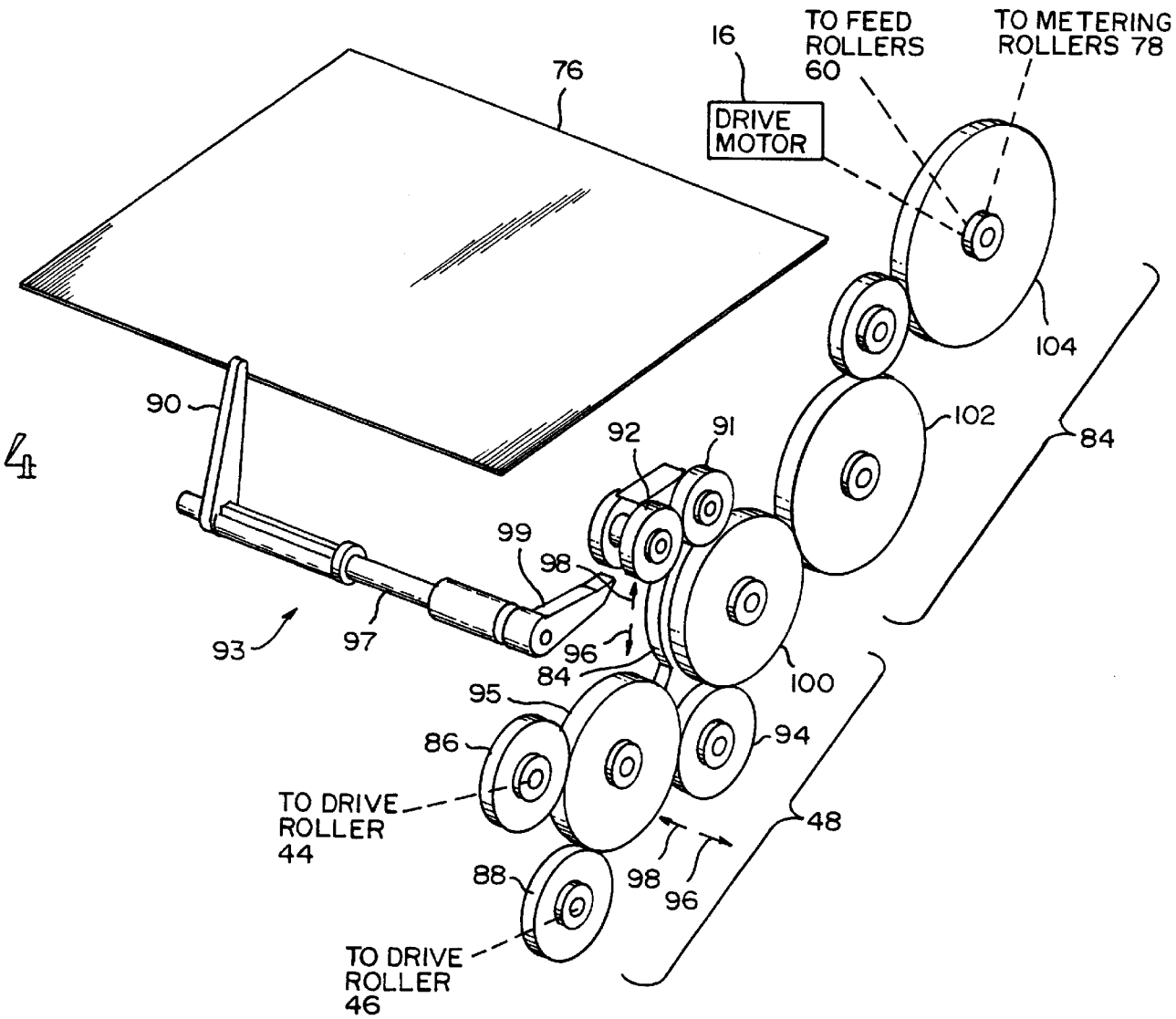
FIG. 4 is a diagram of the duplex media handling system transmission and the simplex media handling system gear linkage of FIG. 3 according to one embodiment of this invention.

Referring to FIG. 4, the gear linkage 84 of the simplex media handling system 14 is coupled to the transmission 48 of the duplex media handling, system. The transmission 48 and gear linkage 84 couple the drive rollers 44, 46 to the drive motor 16. The transmission 48 includes a first drive ear 86 for the first drive roller 44 and a second drive gear 88 for the second drive roller 46. Through a subset of gears 86, 88, 91,92, 94, 95, and 100, the transmission 48 engages the drive rollers 44, 46.

Gear 100 serves as a coupling gear which links the transmission 48 to the gear linkage 84 of the simplex media handling system (e.g., at gear 102). Gear 100 is driven by the drive motor 16 through the gear linkage 84. Transmission gears 91, 92, and 94 are coupled to gear 100, and are mounted to a gear mount 89. The rotation of gear 100 causes the gears 91, 92 and 94 and gear mount 89 to move about the gear 100 in one of two directions 96, 98. Movement of the gears 91, 92, 94 in direction 96 brings gear 92 into engagement with gear 95, and gear 94 out of engagement with gear 95, causing drive gears 86, 88 to rotate in the opposite direction. In this engagement of gears 92 and 95, the transmission 48 is considered to be in first gear. Movement of the gears 91,92, 94 in direction 98 brings gear 94 into engagement with gear 95, and gear 92 out of engagement with car 95, causing drive cars 86, 88 to rotate in one direction. In this engagement of gears 94 and 95, the transmission 48 is considered to be in second gear. In first gear, the drive rollers 44, 46 rotate in the same direction as the feed rollers 60 and metering rollers 78 of the simplex media handling system. In second gear, the drive rollers 44, 46 rotate in the opposite direction as the feed rollers 60 and metering rollers 78 of the simplex media handling system.

When the duplex media handling system is installed, gear 100 engages the gear linkage 84 of the simplex media handling, system 14 at an interface gear 102. Gear linkage 84 also includes a drive gear 104 which is coupled to the drive motor 16 through a linkage included to drive the feed rollers 60 and metering rollers 78.

The transmission 48 also includes a lever mechanism 93 for controlling whether the transmission operates in neutral, first gear or second gear. The lever mechanism 93 includes a lever arm 90 and an interference member 99 coupled by a rigid arm member 97. The lever member 90 is located in the media path of the duplex media handling module 22. The interference member 99 is position in relation to the transmission ear 92, and moves as a "dog" to the lever arm 90 motion.

The lever arm 90 is moved by a media sheet M moving, along the media path into the duplex media handling system 22. As the lever arm 90 moves, the interference member 99, rigidly coupled to the lever arm 90 through arm 97, also moves. The detailed operation of the transmission 48 and lever mechanism 93 is described below in the operation section with regard to FIG. 10–14.

In a preferred embodiment the feed rollers 60 and metering, rollers 78 are driven in a common direction during simplex or duplex media handling. That common direction changes during, duplex printing, but is the same for the feed rollers 60 and metering rollers 78. Depending on the position of gears 92, 94, the drive rollers 44, 46, while engaged, rotate in either the same direction as the feed rollers 60/metering, rollers 78 or in the opposite direction as the feed rollers 60/metering rollers 78. While the drive rollers 44/46 are engaged, one drive roller 44/46 always rotates in the same direction as the other drive roller 46/44. The specific gear linkages for the transmission 48 and linkage 84 may vary depending on the specific embodiment. For example the relative positioning and size of the simplex media handling system 14 and duplex media handling, system 22 may vary, resulting in differing, transmission 48 and linkage 84 embodiments.

Operation

Figure 5:
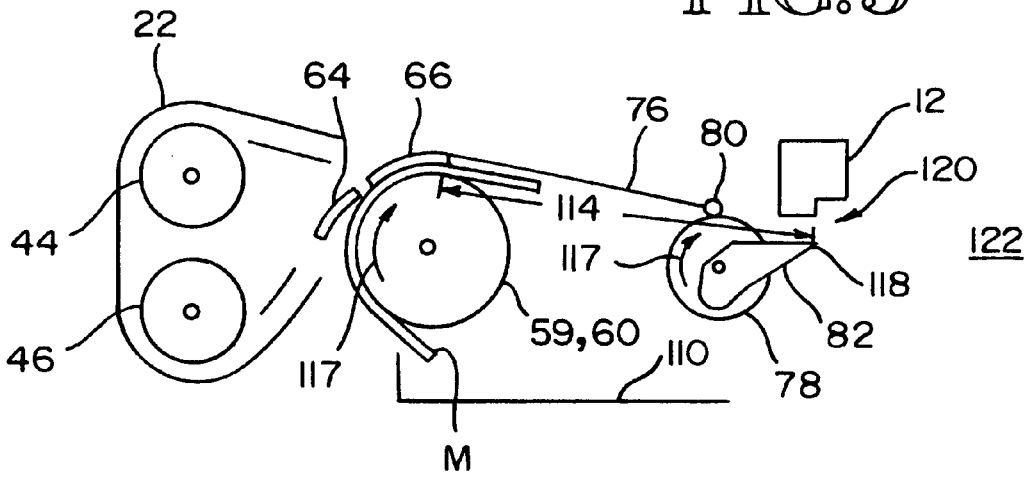
FIG. 5 is a diagram of the duplex media handling system and simplex media handing system during the pick and feed of a media sheet.

The media handling operations for simplex and duplex media recording are described with regard to FIGS. 5–14. For either simplex or duplex print recording, a media sheet M is lifted into contact with a pick roller 59. The top sheet M is picked from a stack of media sheets in an input tray 110. Excess sheets are retarded by a restraint pad system 112 (see FIGS. 2, 3). Referring to FIGS. 2 and 5, the picked media sheet M is fed around feed rollers 60. The feed idlers 62 and pinch rollers 70, 71 press the media sheet to the feed and pick rollers 59, 60. The media sheet pushes the flip guides 64, 66 out of the media path as the media sheet moves along the feed rollers 60. Beyond the flip guides 64, 66 the media sheet moves along a first media path 114. The media path 114 spans a path from rollers sleds 68/pinch rollers 70 to the metering rollers 78 and into a print zone 120. The media sheet is moved between the feed rollers 60 and the rollers sleds 68/pinch rollers 70, under the upper guide 76 and onto the metering rollers 78. Pinch rollers 80 press the media sheet to the metering rollers 78. Both the metering rollers 78 and the feed rollers 60 are moving in a forward direction 117 during the first side printing operation. Eventually a trailing, edge of the media sheet M passes beyond the feed rollers 60 so that the metering rollers 78 move the media sheet. Beyond the pinch rollers 80, the media sheet is moved along a platform 118 of the pivot mechanism 82. The print source 12 is located adjacent to the platform 118. The area between the platform 118 and the print source 12 is referred to herein as the print zone 120. The media sheet M is fed through the print zone 120 into an output region 122, which in some embodiments includes an output tray 124. For simplex printing, the media sheet is released into the output region 122. Immediately or after a suitable drying time (depending on the type of print source), another media sheet may be picked and fed along the media path through the print zone for print recording.

Figure 10:
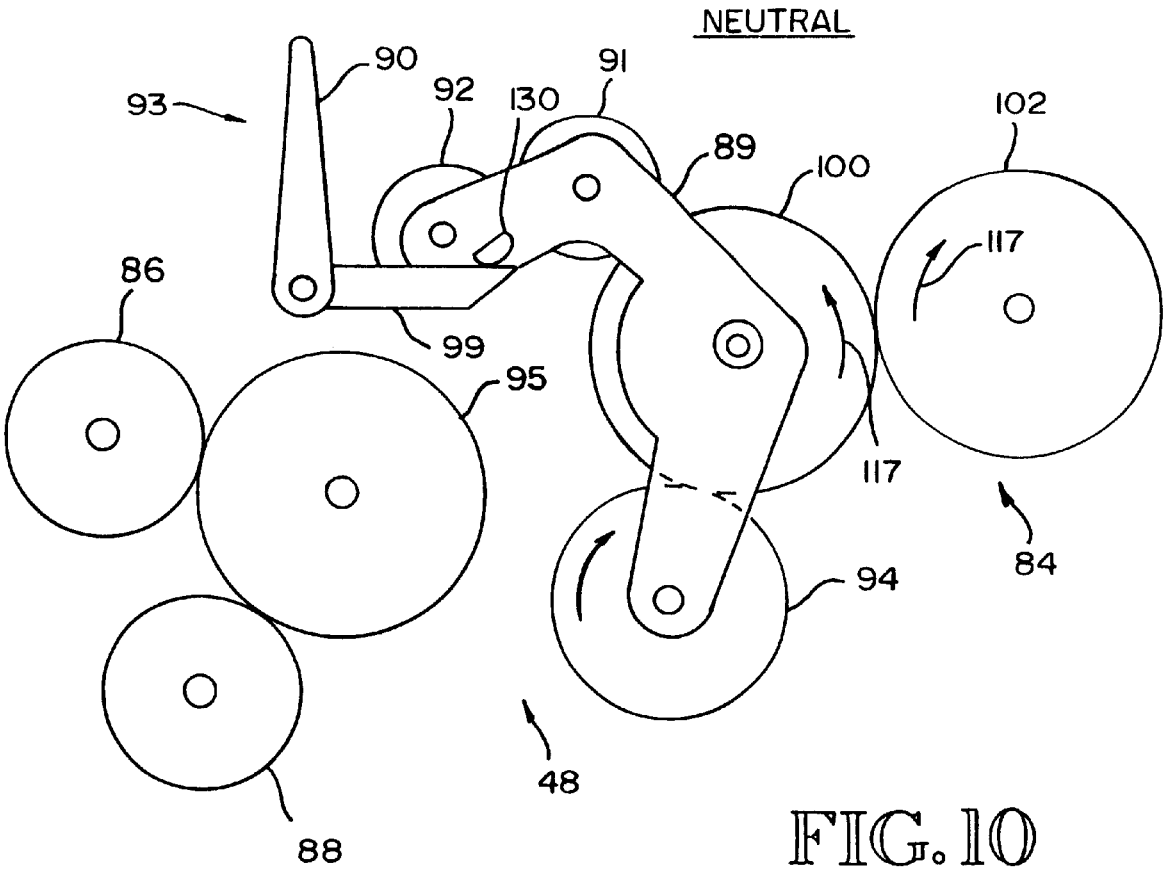
FIG. 10 is a diagram of the transmission and a portion of the gear linkage of FIG. 4 with the transmission in neutral.

During the first side printing, the feed rollers 60 and metering rollers 78 are rotating in a forward direction 117. Referring to FIG. 10, gears 100, 102 102 are rotating in directions corresponding to the forward direction. The rotation of gear 100 causes the pivot plate 89 to rotate clockwise (due to friction). The pivot plate 89, however includes a stop bump 130 which moves into contact with the interference member 99. The pivoting of the pivot member 98 is stopped before it is able to bring gear 92 into engagement with gear 95. Thus, gears 95, 86, and 88 are not driven during the paper advancement of the first side printing operation. The transmission 48 is considered to be in neutral.

Figure 6:
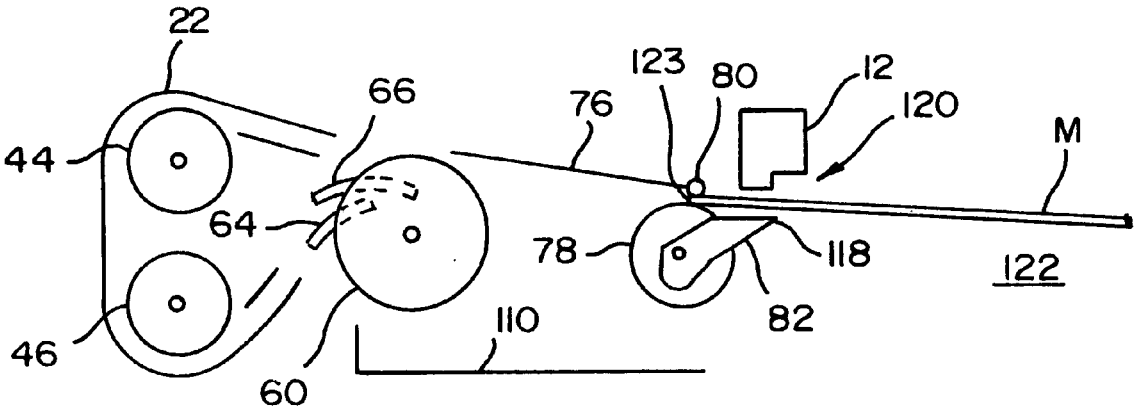
FIG. 6 is a diagram of the duplex media handling system and simplex media handing system at the completion of first side printing where the rollers are stopped with the media sheet trailing edge gripped by the metering rollers.

For duplex printing, the above operations occur for first side printing. However, the trailing edge 123 of the media sheet M is not released during the first-side printing. Referring to FIG. 6, while the pinch roller 80 presses the trailing edge 123 of the media sheet M to the metering roller 78, the motion of the feed rollers 60 and metering rollers 78 ceases. A suitable drying time is allowed before the drive motor 16 reverses the rotational direction of the feed rollers 60 and metering rollers 78 to a direction 121 (see FIG. 7). The sensor 40, which also serves to indicate whether the duplex media handling, system is installed, in one embodiment for a wet ink print recording system (e.g., inkjet print recording) is a humidity sensor. The sensor 40 detects the ambient humidity. Controller 18 in response to the detected humidity determines a sufficient drying time before allowing the media sheet to be moved for second side printing. In alternative embodiments separate sensors are used to determine humidity and whether the duplex media handling system is installed. In other embodiments, a sensor is not included for detecting drying time (e.g., non-wet ink printing; a worst case, or even a typical case, drying time is programmed in without sensory indication). Regardless of the sensor 40 embodiment, the controller 18 includes firmware programmed to handle simplex printing or duplex printing. The sensor 40 indication of whether the duplex media handling system is installed or not installed is used by the firmware to determine whether the duplex mode is available.

The determination of when to stop the metering rollers 78 with the media sheet trailing edge grasped is now described. The simplex media handling, system 14 includes a media sensor 72 and flag 74 (see FIGS. 2 and 3). When the media sheet M is moved along the first media path 114 from the feed rollers 60 toward the metering rollers 78, the lead edge of the media sheet trips the flag 74. Once the trailing edge 123 passes beyond the flag, the flag 74 returns to its unbiased position. The sensor 72 indicates when the leading edge and trailing edge of the media sheet M have passed the flag 74. These indications are detected by the controller 18 which then determines when the trailing edge 123 of the media sheet M is at the pinch roller 80. At such time the controller 118 has the drive motor 16 discontinue rotation of the feed rollers 60 and metering rollers 78. After a programmed pause (e.g., to allow for first side drying), the controller 18, then signals to the drive motor 16 to reverse the rotational directions of the feed rollers 60 and metering rollers 78 to the reverse direction 121.

Figure 7:
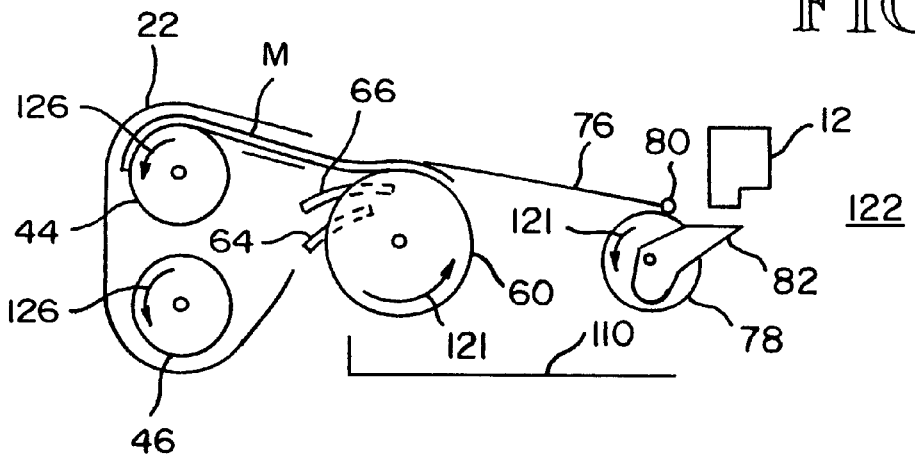
FIG. 7 is a diagram of the duplex media handling, system and simplex media handing system where the media sheet is being fed back along, the media path into the duplex media handling, system.

Referring to FIG. 7, the metering rollers 78 feed the media sheet M back along the first media path 114 into contact with the feed rollers 60. The feed rollers 60 then continue feeding the media sheet back. Eventually the media sheet M is out of the grasp of the metering, rollers 78 and fed back only by the feed rollers 60 (as distinguished from both the feed rollers 60 and metering rollers 78). As the media sheet M is fed back to and then onto the feed roller the flip guides 64, 66 are positioned in their unbiased position (see position in FIGS. 2 and 3). The unbiased position has the flip guides blocking the path around the feed rollers 60 back toward the input tray 110. Instead, the media sheet M is fed over a support surface of the flip guide 66 into the duplex media handling system module 22.

Referring to FIGS. 11 and 12, the transmission 49 is shown during the reverse motion of the media sheet M. With the feed rollers 60 rotating in a reverse direction 121, the transmission gear 100 rotation induces the pivot plate 89 (gear mount) to rotate in a direction 98. Such rotation 98 is due to a friction force between an axle of gear 100 and pivot plate 89. As the pivot plate 89 rotates in direction 98, the gear 94 is brought into engagement with gear 95. Accordingly, a linkage is established through the transmission 48 to drive the gears 86, 88. The gears 86, 88 are coupled to the duplex media handling drive rollers 44, 46. The transmission is in second gear.

As the media sheet M is fed into the duplex media handling system 22, the media sheet M encounters the lever arm 90 of the lever mechanism 93. The media sheet M moves the lever arm 90 as the media sheet progresses. The interference member 99 follows the movement of the lever arm 90 rotating the lever mechanism 93 from a first position 132 (see FIG. 11) into a deflected, second position 134 (see FIG. 12). Note that the interference member 99 is moved out of the rotational path of pivot member 89.

The feed rollers 60 feed the media sheet M toward and onto the first drive roller 44. As a result, when the media sheet is fed from the feed rollers 60 to the duplex media handling system drive roller 44, the drive rollers 44, 46 are rotating in a direction 126 (see FIG. 7). The drive roller 44 feeds the media sheet to drive roller 46. The drive rollers 44, 46, and then drive roller 46 alone feeds the media sheet along path 52 (see FIG. 3) back toward the feed rollers 60.

The duplex media handling, system 22 has a media path length from entry point 54 to exit point 56 (see FIG. 3) which is at least as long as the maximum rated media sheet length for automatic duplex handling (e.g., 11 inches; 14 inches; 17 inches). If, however, automatic duplex handling, is limited to a specific size, such as 11 inches or A4 paper length, then simplex printing (and manual duplex printing) may still print to larger sheets (e.g., 14 inches; 17 inches). Prior to the time the media sheet is fed out of the duplex media handling system 22 back onto the feed rollers 60, the feed rollers 60 are to change direction from reverse direction 121 back to the forward direction 117. However, the direction through the duplex media handling system module should stay the same (i.e., direction 126) even when the feed rollers 60 go back to the forward rotational direction 117. The forward rotational direction as used herein refers to the direction 117 which the feed rollers 60 rotate to move the media sheet from the feed rollers 60 to the metering rollers 78 along the first media path 114.

The process to change directions of the feed rollers 60 back to the forward direction 117, while the media sheet is in the duplex handling system 22, is now described. As the media sheet advances into the duplex media handling system 22 over the lever arm 90, the drive motor 16 changes directions. Such change of direction occurs while the media sheet is holding the lever mechanism 93 in the deflected position 134. In one embodiment the lever arm 90 is positioned near the exit point 56 to assure that the entire media sheet as advanced out of contact with the feed rollers 60. In an alternative embodiments a signal from the sensor 72 or flag, 75 are used by the controller to determine the media sheet length to assure that the media sheet is in the duplex media handling system 22 out of contact with the feed rollers 60. Referring to FIGS. 12 and 13, with the drive motor 16 changing directions the direction of rotation of gears 102, 100 change to the forward direction 117. The change in direction of gear 100 causes the pivot plate 89 to rotate in direction 96. Such rotation moves gear 94 out of engagement with gear 95 and moves gear 92 into engagement with gear 95. With the paper holding the lever arm 90 in the deflected position 134, the interference member 99 is out of the path of gear 92 and pivot plate 89. Thus, the stop member 130 and interference member 99 do not form a stop. Gear 92 moves into engagement with gear 95 as shown in FIG. 13. The action between gear 92 and gear 95 while gear 100 rotates in direction 117 is the same rotational action as between gear 94 and gear 95, while gear 100 rotates in the backward direction 121. Accordingly, while the feed rollers and metering rollers have switched from a backward rotation to a forward rotation, the drive rollers 44, 46 of the duplex media handling system 22 are driven in a constant direction. Thus, the media sheet M continues along the path 52 (see FIG. 3) through the duplex media handling system 22.

Figure 8:
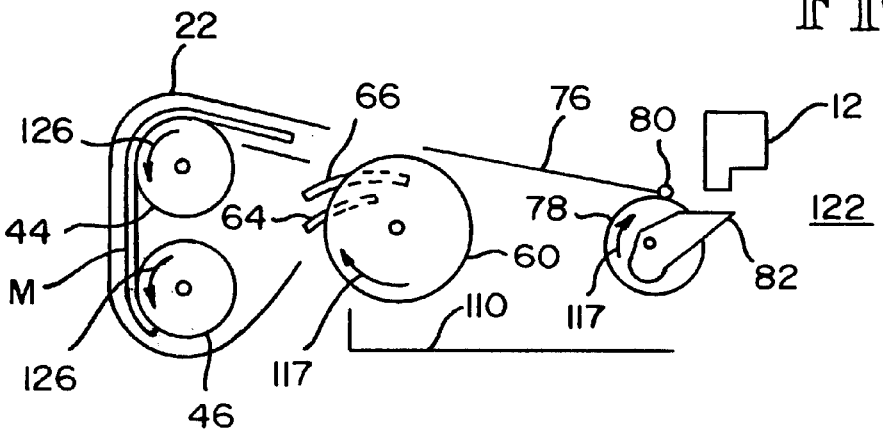
FIG. 8 is a diagram of the duplex media handling system and simplex media handing system where the media sheet is completely within the duplex media handling system.
Figure 9:
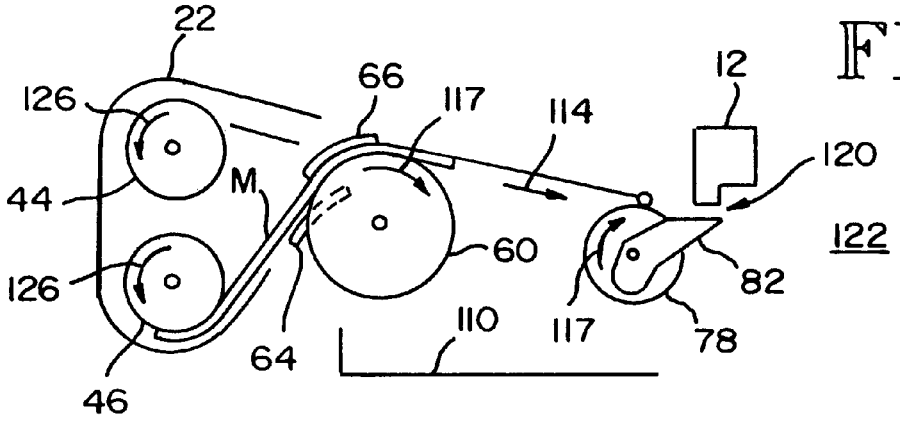
FIG. 9 is a diagram of the duplex media handling, system and simplex media handing system during feeding of the media sheet from the duplex media handling system back to the simplex media handling system for second side print recording.

FIG. 8 shows the media sheet M in the duplex media handling system 22 with the feed rollers 60 restarted in the opposite direction. Referring to FIG. 14, once the media sheet M passes beyond the lever arm 90, the lever arm rotates out of the deflected position 134. In one embodiment the lever mechanism 93 is spring-biased to the first position 132 (see FIG. 11). As the lever arm 90 moves from the deflected position 134 while the gears are rotating in the direction 117 the interference member 99 comes to rest on the stop member 130 as shown in FIG. 14. Compare the relation of the interference member 99 and the stop member 130 in FIGS. 10 and 14. While the transmission is in neutral (FIG. 10) the interference member 99 blocks the pivot member 89 so that gear 92 does not engage the gear 95. When the transmission is already in first gear, however, the interference member does not block such motion (e.g., because the motion has already occurred). The transmission remains in first gear while the drive motor continue to drive gears 100, 102 in direction 117. In one embodiment, the transmission is allowed to continue in first gear during second side printing of the current media sheet and first side printing of the next media sheet(s). When the drive motor reverses to drive gears 100, 102 in the reverse direction, the pivot plate swings in direction 98. Once the interference member 99 clears the stop member 130, the lever mechanism 93 swings back to its biased first position 132.

With the feed rollers 60 and metering rollers 78 rotating in direction 117 while the drive rollers 44, 46 rotating in direction 126, the media sheet M is fed out of the duplex media handling system 22 back onto the feed rollers 60. As a lead edge of the media sheet exits the duplex media handling system 22, such edge moves the flip guide 66 out of its path allowing the media sheet to be grasped by the feed rollers 60 and pinch rollers 71 and moved back onto the first media path 114 (see FIG. 9 and FIG. 5 for first media path 114). The media sheet M goes over the flip guide 64 and under the flip guide 66. The media sheet M is fed along, the first media path 114 under the upper guide 76 for top of form sensing, with sensor 72 and flags 74, 75, and onto the metering rollers 78 and the platform 118, into the print zone 120 for second side print recording. The media sheet M is fed through the print zone 120 into the output region 122. The media sheet then is released into the output region 122. Immediately or after a suitable drying time (depending on the type of print source), another media sheet may be picked and fed along, the media path through the print zone for simplex or duplex print recording.

Meritorious and Advantageous Effects

One advantage of the invention is that media flipping is provided without user intervention or reinsertion. Another advantage is that additional motors are not needed for the duplex module. The duplex module is powered by the simplex media handling system. Another advantage is that the transmission switches gears in response to a lever, activated by the media sheet motion, rather than in response to a drive motor jogging action. As a result the time to shift gears reduces. Correspondingly, the time to perform a duplex handling print cycle is reduced and the printer throughput is increased.

Another advantage is that by avoiding activation by the drive motor a larger design margin is tolerated by the gear train in the transmission. Another advantage is that a lighter friction load is placed on the drive motor by the interference member. In the embodiment where the clutch is activated by the drive motor a higher, undesirable friction load is placed on the drive motor. Such load is not constant over the life of the printer. Placing of a higher friction load on the drive motor reduces accuracy in controlling print media stopping, thereby compromising printed image quality. The interference member places a much lower, less critical friction load on the drive motor. According to another advantage of the invention, by activating the transmission drive modes directly in response to the media sheet position, precise drive motor position control is not needed as it would be in embodiments where the clutch is driven by the drive motor. The direct actuation of the transmission drive mode frees up bandwidth for the print controller.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A print recording apparatus for recording print onto a media sheet, comprising:

a print recording source;

a simplex media handling assembly for moving a media sheet along a media path to receive print recording, the simplex media handling assembly comprising a feed roller;

a drive motor for driving rotation of the feed roller;

a removable duplex media handling module interfacing with the simplex media handling assembly to provide a media path for flipping the media sheet for second side printing, the duplex media handling module comprising a duplex handling drive roller and a transmission coupled to the drive motor; and a media-activated lever mechanism coupled to the transmission for determining a gear engagement of the transmission.

2. The apparatus of claim 1, in which the lever mechanism comprises a lever arm in the media path which is deflected from a first position into a second position by a passing media sheet.

3. The apparatus of claim 1, in which the lever mechanism comprises a first member which blocks the transmission from operating in a given gear mode while the lever mechanism is in a first position and the drive motor is driving rotation in a first direction.

4. The apparatus of claim 1, wherein the media-activated lever mechanism determines whether the transmission operates in neutral gear mode or a first gear mode.

5. The apparatus of claim 4, wherein the media-activated lever mechanism has no impact on when the transmission is to operate in a second gear mode.

6. The apparatus of claim 1, in which the transmission comprises a pivot plate coupled to a drive gear, the drive gear being coupled to the drive motor, the pivot plate pivoting, in a first pivotal direction while the drive motor drives rotation of the drive gear in a first rotational direction, the pivot plate pivoting in a second pivotal direction while the drive motor drives rotation of the drive gear in a second rotational direction, wherein the media-activated lever mechanism moves from a first position into a second position when deflected by a passing media sheet.

7. The apparatus of claim 6, wherein the transmission enters a first ear mode when the drive motor switches into driving rotation of the drive gear in the first rotational direction, for a case in which the media-activated lever mechanism is in the first position and enters a neutral gear mode for a case in which the media-activated lever mechanism is in the second position.

8. The apparatus of claim 6, wherein the transmission enters a second gear mode when the drive motor switches into driving rotation of the drive gear in the second rotational direction regardless of position of the media-activated lever.

9. A method for operating a transmission of a removable duplex-media handling system, the duplex media handling, system coupled to a simplex media handling system, the duplex media handling system and the simplex media handling system being driven by a common drive motor, the drive motor having a drive axle, said transmission coupled to the drive motor, the method comprising the steps of:

operating the transmission in a second gear mode while the drive motor rotates the drive axle in a first rotational direction;

operating the transmission in either one of a neutral gear mode or a first gear mode while the drive motor rotates the drive axle in a second rotational direction, said one of the neutral gear mode and the first gear mode determined based upon a position of a media-activated lever which is coupled to the transmission.

10. The method of claim 9, wherein the transmission includes a pivot plate coupled to a drive gear, the drive gear being coupled to the drive axle, the method further comprising the steps of:

pivoting the pivot plate in a first pivotal direction while the drive axle rotates in the first rotational direction;

pivoting the pivot plate pivoting in a second pivotal direction while the drive axle rotates in the second rotational direction; and moving the media-activated lever mechanism moves from a first position into a second position by a media sheet moving over the lever mechanism.

11. The method of claim 10, further comprising the steps of:

entering the transmission into the first gear mode when the drive motor changes rotation of the drive axle to the first rotational direction, for a case in which the media-activated lever mechanism is in the first position; and entering, the transmission into the neutral gear mode when the drive motor changes rotation of the drive axle to the first rotational direction, for a case in which the media-activated lever mechanism is in the second position.

12. The method of claim 11, further comprising the step of:

entering the transmission into the second gear mode when the drive motor changes rotation of the drive axle to the second rotational direction regardless of position of the media-activated lever mechanism.

13. A method for moving, a media sheet through a duplex media handling system to achieve flipping of a media sheet for second side printing, comprising the steps of:

feeding the media sheet along a first media path into a print zone for first side print recording with a drive motor rotating a drive axle in a first rotational direction;

reversing rotation of the drive axle into a second rotational direction to reverse motion of the media sheet along the first media path after completing first side print recording to move the media sheet into the duplex media handling system onto a second media path;

engaging a transmission of a removable duplex media handling module into a second gear mode in response to said step of reversing, the transmission coupling the drive axle to a drive roller of the duplex media handling, system;

deflecting, by the media sheet a lever coupled to the transmission, as the media sheet moves along the second media path, the lever being deflected from a first position into a second position, wherein in the first position the lever prevents the transmission from entering the first ear mode and while in the second position the lever arm does not prevent the transmission from entering, the first gear mode;

after the media sheet clears the first media path and is continuing to deflect the lever into the first position, reversing rotation of the drive axle back to the first rotational direction; and engaging the transmission into a first gear mode in response to said step of reversing rotation back, wherein with the transmission engaged in either one of the first gear mode or the second gear mode the drive roller is rotated in a common direction to move the media sheet along the second media path and back to the first media path for second side printing.

14. The method of claim 13, further comprising the steps of:

entering the transmission into the first gear mode when the drive motor changes rotation of the drive axle to the first rotational direction, for a case in which the media-activated lever mechanism is in the first position; and entering the transmission into the neutral gear mode when the drive motor changes rotation of the drive axle to the first rotational direction, for a case in which the lever is in the second position.

15. The method of claim 14, further comprising the step of:

entering the transmission into the second gear mode when the drive motor changes rotation of the drive axle to the second rotational direction regardless of position of the lever.

* * * * *

UNITED STATES PATENT AND TRADEMARK OFFICE

CERTIFICATE OF CORRECTION

PATENT NO. : 6,293,716 B1
DATED : September 25, 2001
INVENTOR(S) : Driggers et al.

It is certified that error appears in the above-identified patent and that said Letters Patent is hereby corrected as shown below:

Title page,
Item [57], ABSTRACT,
Line 5, delete "or" and insert therefor -- of --.
Line 6, delete "system." and insert therefor -- system and the duplex handling drive rollers of the duplex media handling system. --

Column 10,
Line 7, delete "pivoting," and insert therefor -- pivoting --.
Line 14, delete "ear" and insert therefor -- gear --.
Line 25, delete "handling," and insert therefor -- handling --.
Line 59, delete "entering," and insert therefor -- entering --.

Signed and Sealed this

Fifth Day of August, 2003

JAMES E. ROGAN
*Director of the United States Patent and Trademark Office*